United States Patent [19]

Kanai et al.

[11] 4,428,802

[45] Jan. 31, 1984

[54] PALLADIUM-NICKEL ALLOY ELECTROPLATING AND SOLUTIONS THEREFOR

[75] Inventors: Masao Kanai, Suwa; Hirotomo Koshiro, Ichihara, both of Japan

[73] Assignees: Kabushiki Kaisha Suwa Seikosha; Nisshin Kasei Kabushiki Kaisha, both of Tokyo, Japan

[21] Appl. No.: 303,663

[22] Filed: Sep. 18, 1981

[30] Foreign Application Priority Data

Sep. 19, 1980 [JP] Japan ..... 55-130362

[51] Int. Cl.[3] ..... C25D 3/56

[52] U.S. Cl. ..... 204/43 N

[58] Field of Search ..... 204/43 N, 123, 43 T

[56] References Cited

U.S. PATENT DOCUMENTS 3,580,820 5/1971 Yamamura et al. ..... 204/43 N 3,933,602 1/1976 Henzi et al. ..... 204/44

4,297,177 10/1981 Fletcher et al. ..... 204/43 N

FOREIGN PATENT DOCUMENTS 212692 5/1968 U.S.S.R. ..... 204/43 N

*Primary Examiner*—G. L. Kaplan

*Attorney, Agent, or Firm*—Blum, Kaplan, Friedman, Silberman and Beran

[57] ABSTRACT

A palladium-nickel alloy plating solutions formed from tetramminepalladous chloride is provided. The tetramminepalladous chloride is soluble in aqueous ammonia plating solution and is also water soluble. This permits replenishment of the palladium in a palladium-nickel plating solution during plating operation merely by adding the tetramminepalladous palladius chloride as a solid which is easily dissolved. The palladium-nickel alloy plating solutions contain between about 5 to 30 g/l of palladium and 5 to 30 g/l of nickel.

17 Claims, No Drawings

PALLADIUM-NICKEL ALLOY ELECTROPLATING AND SOLUTIONS THEREFOR

BACKGROUND OF THE INVENTION

This invention relates to palladium-nickel alloy plating soltuions, and in particular to palladium-nickel alloy solutions wherein palladium is added to the plating solution as tetramminepalladous chloride.

Palladium-nickel alloy plating solutions are generally disclosed in U.S. Pat. No. 3,580,820, issued on May 25, 1971 to Yamamura, et al. and assigned in part to the assignee of the subject application. The palladium-nickel alloy plating solutions of the Yamamura, et al. patent contain between about 5–30 g/l of palladium and 5–30 g/l of nickel. The source of the palladium is a monosalt, such as palladium chloride $PdCl_2$ and a complex salt, such as palladous amino chloride $Pd(NH_3)_2Cl_2$. Replenishment of the plating solutions is accomplished by adding the palladium salt directly to the bath together with additional ammonia water and dilute sulfuric acid to increase solubility. This tends to increase the volume of the plating solution. Additionally, these conventional plating solutions tend to generate an odor due to ammonia.

Accordingly, it would be desirable to provide an improved palladium-nickel alloy plating solution which does not present the problems associated with the prior art plating solutions.

SUMMARY OF THE INVENTION

Palladium-nickel alloy plating solutions prepared in accordance with the invention contain between about 5 to 30 g/l of palladium and 5 to 30 g/l of nickel as the metal composition in the plating solutions. The palladium in the plating solution is tetramminepalladous chloride. The tetramminepalladous chloride is soluble in an aqueous ammonia solution and also a water soluble compound. Thus, plating solutions may be replenished, due to the water solubility, by adding solid tetramminepalladous chloride, which dissolves in a short period of time. The plating solutions prepared in accordance with the invention provide for a palladium-nickel alloy plate having between about 30 to 90% palladium and excellent corrosion resistance.

Accordingly, it is an object of the invention to provide an improved palladium-nickel alloy plating solution.

Another object of the invention is to provide a palladium-nickel alloy plating solution wherein palladium is added as a salt which is soluble in aqueous ammonia and is water soluble.

A further object of the invention is to provide an improved palladium-nickel alloy plating solution wherein the source of palladium is tetramminepalladous chloride.

Yet another object of the invention is to provide an improved palladium-nickel solution which may be replenished by adding a palladium salt which is soluble in the aqueous ammonia plating solution and is water soluble.

Yet a further object of the invention is to provide an improved palladium-nickel plating solution which is replenished by adding tetraminepalladous chloride.

Still other objects and advantages of the invention will in part be obvious and will in part be apparent from the specification.

The invention accordingly comprises a composition of matter possessing the characteristics, properties, and the relation of components which will be exemplified in the composition hereinafter described, and the scope of the invention will be indicated in the claims.

DESCRIPTION OF THE PREFERRED EMBODIMENTS

The palladium-nickel alloy plating solutions prepared in accordance with the invention represent an improvement of the plating solutions described in Yamamura, et al. U.S. Pat. No. 3,580,820. This improvement is adding palladium to the solution in the form of tetramminepalladous chloride. When plating is performed utilizing a mixed aqueous solution of this complex amine salt of palladium and a nickel salt as a plating solution, palladium and nickel are electro-deposited simultaneously in the form of an alloy. In this alloy, both metals are fused with each other, thereby providing an easy route to provide a palladium-nickel alloy plate.

A particular feature of the plating solutions prepared in accordance with the invention is due to the fact that tetramminepalladous chloride, which is the source of palladium, is soluble in aqueous ammonia. Additionally, the tetramminepalladous chloride is also a water soluble compound. Thus, it is particularly advantageous during the plating operation that the palladium source be soluble. This permits replenishment of the palladium in the palladium-nickel plating solution during continuous plating operations merely by adding solid tetramminepalladous chlorine compound, because it is water soluble. Thus, even when adding the salt in solid form, it is readily dissolved in the plating solution over a short period of time.

The advantages obtained when the palladium compound can be readily dissolved in the plating solution in the form of a solid are readily apparent. When replenishment of the plating solution is conducted during the plating operation, this addition of salt does not cause a problem, such as an increase in the volume of the palladium-nickel plating solution. Additionally, since replenishment can be done in a relatively short period of time, any time necessary to interrupt the plating operation can be held to a bare minimum. Further, the palladium content in the electro-deposited alloy can be maintained in the desired range of 30–90% in view of the ability to adjust the palladium concentration easily. By appropriately controlling the composition of the plating solution, or the plating conditions, it is possible to insure that the palladium content in the electro-deposited alloy will always be within the desired range of 30–90%.

The concentration of palladium and nickel utilized in plating solutions prepared in accordance with the invention is generally from about 5 to 30 g/l for both the palladium and nickel. The alloy ratio of palladium to nickel in the electro-deposited alloy varies depending on the concentration ratio of palladium to nickel in the plating solution. For example, as shown in the examples described below, a combination of 25 g/l of palladium and 10 g/l of nickel in the plating solution yields an electro-deposited alloy containing about 86% palladium. Additionally a plating solution including 10 g/l of palladium and 10 g/l of nickel yields a palladium-nickel plate containing about 53% palladium.

The composition of the electro-deposited alloy is influenced not only by the concentration ratio of palladium to nickel in the plating solution, but also by other conditions, such as, the pH, the temperature, the cathode current density, etc., of the plating solution. Nevertheless, it is easy to maintain these conditions constant while varying other conditions. Factors other than the pH of the plating solution generally do not provide a sharp influence in the final composition, and therefore, it is possible to obtain an electro-deposited alloy having a desired composition. These desired compositions may be obtained by controlling the concentrations of palladium and nickel, in the plating solution.

It is also possible to obtain a more lustrous plating utilizing a plating solution including a naphthalene sulfonic acid, naphthalene sulfonates, aromatic sulfonamide, or the like in the plating solution described above. These additional sulfa compounds are described in detail in the Yamamura, et al. patent.

While the plating is being performed, it is necessary to control properly the concentrations of palladium and nickel by quantitatively analyzing the solution by chemical analysis. Replenishment of the palladium and nickel may be effected by directly adding and dissolving the salts into the plating solution. As the plating operation proceeds, ammonium salts generally accumulate in the plating solution, however, this does not adversely affect the plating solution.

The pH of the plating solution may be adjusted by adding an alkali hydroxide or dilute sulfuric acid. Generally, a reduction in pH tends to increase the nickel deposition potential, thereby increasing the content of nickel in the electro-deposited alloy. Additionally, due to improper plating compositions, it is possible to obtain an electro-deposited alloy wherein the palladium content does not fall within the desired range of about 30–90%. In such cases, the greater the content of palladium in the electro-deposited alloy deviates from the desired range of about 30–90%, the less complete the formation of a solid solution of the palladium and nickel. These cases generally tend to provide thick platings, poor lustre, cracking, etc., of the plated surface. Other plating conditions utilized in similar operations may be employed herein. Additionally, there are no special restrictions on the type of base metal which can be plated with solutions prepared in accordance with the invention.

The following examples are presented as illustrative of the invention described above in detail. It is understood that the examples are merely illustrative, and not presented in a limiting sense.

EXAMPLE 1

Into 700 cc of water were dissolved 24.8 g (10 g as Pd) of tetramminepalladous chloride $[Pd(NH_3)_4Cl_2.H_2O]$, 67.3 g (10 g as Ni) of ammonium nickel sulfate $[Ni(NH_4)_2(SO_4)_2.6H_2O]$ and 50 g of ammonium sulfate $[(NH_4)_2SO_4]$. Potassium hydroxide was added to adjust the pH of the solution to 7.2 and water was added to bring the total volume to 1,000 cc.

Utilizing this solution as a plating solution, plating was conducted for 30 minutes under the following conditions. The temperature was maintained at 30° C., a cathode current density of 1 A/dm$^2$ was maintained. A palladium plate was utilized as an anode and a brass plate was utilized as a cathode. The deposited alloy obtained had a thickness of about 10 microns and was about 53% palladium and 47% nickel. The deposited alloy had a white, smooth surface which did not exhibit any cracking and exhibited good adhesion.

The plated product was tested for corrosion resistance by exposure to ammonia vapor for 24 hours and then immersed in artificial sea water for 6 days. There was no abnormality in the plated surface observed.

EXAMPLE 2

Into 700 cc of water were dissolved 42.4 g (10 g as Ni) of nickel acetate $[Ni(CH_3COO)_2.4H_2O]$ and 100 g of ammonium acetate $[CH_2COONH_4]$. Potassium hydroxide was added to adjust the pH of the solution to 8.0. Thereafter, 61.9 g (25 g as Pd) of a crystalline powder tetramminepalladous chloride $[Pd(NH_3)_4Cl_2.H_2O]$ was added to the solution and permitted to dissolve. Water was added to bring the total volume to 1,000 cc.

Using this solution as a plating solution, plating was conducted for 35 minutes at a temperature of 30° C. A cathode current density of 1 A/dm$^2$ was maintained with a palladium plate as an anode and a brass plate as a cathode. The deposit obtained was a lustrous alloy having a thickness of about 10 microns and contained about 86% palladium and 14% nickel. There was no cracking and the plate showed good adhesion.

The plated product was tested for corrosion resistance by exposure to ammonia for 24 hours and immersed in artificial sea water for 6 days. There were no abnormalities in the plated surface observed.

EXAMPLE 3

Into 700 cc of water were added 10 g, calculated as nickel, of disodium nickel ethylenediaminetatraacetate $[C_{10}H_{12}O_3N_2Na_2Ni.XH_2O]$, 30 g of ammonium sulfate $[(NH_4)_2SO_4]$ and 12.4 g (5 g as Pd) of tetramminepalladous chloride $[Pd(NH_3)_4Cl_2.H_2O]$ and permitted to dissolve. Sodium hydroxide was added to adjust the pH of the solution to 8.0. Water was added to bring the total volume to 1000 cc. Using this solution as a plating solution, plating was conducted for 60 minutes utilizing a plating temperature of 32° C. and a cathode current density of 0.5 A/dm$^2$. A palladium plate was utilized as an anode and a brass plate as a cathode. The electro-deposited palladium-nickel alloy had a thickness of about 10 microns and contained 41% palladium and 59% nickel. The plated surface was smooth with no cracking and exhibited good adhesion.

The plated product was tested for corrosion resistance by exposure to ammonium vapor for 24 hours. After immersion in artificial sea water for 6 days, there was no abnormality observed in the plated surface.

The plating solutions prepared in accordance with the invention are best utilized by adjusting the pH to about 7–9. Additionally, the liquid temperature of the plating solution should be maintained between about 15° and 50° C. with a cathode current density between about 0.5 to A/dm$^2$.

As has been described in detail hereinabove, it is possible to provide a plating solution for a palladium-nickel alloy plating having excellent corrosion resistance. In addition, replenishment of palladium during plating operation is simplified as the palladium salt, namely, the tetramminepalladous chloride added as the source of palladium is soluble in aqueous ammonia and also soluble in water. Thus, replenishment is simplified in that the volume of the plating solution is not increased as the palladium salt may be added directly to the plating solution as a solid. In addition, the plating solution does not generate the ammonia odor as does the conventional plating solutions.

It will thus be seen that the objects set forth above, and those made apparent from the preceding description, are efficiently attained and, since certain changes may be made in the above composition of matter without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A palladium-nickel alloy electro-plating solution for forming an electro-deposited alloy layer having a palladium content between about 30 and 90%, comprising:

an alkaline aqueous solution of from about 5 to 30 g/l of palladium ions, added as tetramminepalladous chloride; and from about 5 to 30 g/l nickel ions;

the source of the nickel ions selected from one of ammonium nickel sulfate or nickel acetate.

2. A palladium-nickel alloy electroplating solution of claim 1, wherein the pH is between about 7 and 9.

3. The palladium-nickel alloy electroplating solution of claim 1, further including at least one sulfo compound for providing a more lustrous plating.

4. The palladium-nickel alloy electroplating solution of claim 3, wherein the sulfo compound is selected from the group consisting of a naphthalene sulfonic acid, naphthalene sulfonates, aromatic sulfonamides, derivatives thereof and mixtures thereof.

5. The palladium-nickel alloy electroplating solution of claim 1, wherein the source of the nickel is ammonium nickel sulfate and the alloy plating solution includes 10 g/l palladium ions and 10 g/l of nickel ions.

6. The palladium-nickel alloy electroplating solution of claim 1, wherein the source of the nickel ions is nickel acetate and the alloy plating solution includes 25 g/l palladium ions and 10 g/l nickel ions.

7. In a process for electrolytic plating of a palladium-nickel alloy including forming an aqueous ammonia plating solution including about 5 to 30 g/l of palladium ions and 5 to 30 g/l of nickel ions, the improvement which comprises replenishing the palladium ions in the plating solution by adding crystalline tetraamminepalladous chloride directly to the plating solution.

8. In the process of plating of claim 7, the step of maintaining the pH between about 7.0 and 9.0.

9. In the process of plating of claim 7, the step of maintaining the temperature between about 15° and 50° C.

10. In the process of plating of claim 7, the step of maintaining the temperature between about 25° and 35° C.

11. In the process of plating of claim 7, the step of maintaining the cathode current density between about 0.5 to 2 $A/dm^2$.

12. In the process of plating of claim 11, the step of maintaining the cathode current density at about 1.0 $A/dm^2$.

13. In the process of plating of claim 7, the step of adding to the plating solution at least one sulfo compound for providing more lusturous plating.

14. In a process for electrolytic plating of a palladium-nickel alloy including forming an aqueous ammonia plating solution including about 5 to 30 g/l of palladium ions and 5 to 30 g/l of nickel ions and adding to the plating solution at least one sulfo compound selected from the group consisting of naphthalene sulfonic acid, naphthalene sulfonates, aromatic sulfonamides, derivatives thereof and mixtures thereof for providing more lustrous plating, the improvement which comprises replenishing the palladium ions in the plating solution by adding crystalline tetraamminepalladous chloride directly to the plating solution.

15. In a process for electrolytic plating of a palladium-nickel alloy including forming an aqueous ammonia plating solution including about 5 to 30 g/l of palladium ions and 5 to 30 g/l of nickel ions and providing the nickel ions in the aqueous ammonia plating solution by dissolving ammonium nickel sulfate the improvement which comprises replenishing the palladium ions in the plating solution by adding crystalline tetraaminepalladous chloride directly to the plating solution.

16. In a process for electrolytic plating of a palladium-nickel alloy including forming an aqueous ammonia plating solution including about 5 to 30 g/l of palladium ions and 5 to 30 g/l of nickel ions and providing the nickel ions in the aqueous ammonia plating solution by dissolving nickel acetate the improvement which comprises replenishing the palladium ions in the plating solution by adding crystalline tetraaminepalladous chloride directly to the plating solution.

17. In a process for electrolytic plating of a palladium-nickel alloy including forming an aqueous ammonia plating solution including about 5 to 30 g/l of palladium ions and 5 to 30 g/l of nickel ions and providing the nickel ions in the aqueous ammonia plating solution by dissolving disodium nickel ethylenediamine-tetraacetate the improvement which comprises replenishing the palladium ions in the plating solution by adding crystalline tetraaminepalladous chloride directly to the plating solution.

* * * * *